US010583341B2

(12) United States Patent
Goldstein

(10) Patent No.: US 10,583,341 B2
(45) **Date of Patent: *Mar. 10, 2020**

(54) TENNIS NET TENSION SYSTEM INCLUDING SERVICE LET INDICATION FEATURE

(71) Applicant: Group One Limited, Ramsey (GB)

(72) Inventor: Fredric Goldstein, Nacka (SE)

(73) Assignee: GROUP ONE LIMITED (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/277,095

(22) Filed: Feb. 15, 2019

(65) Prior Publication Data

US 2019/0176005 A1 Jun. 13, 2019

Related U.S. Application Data

(63) Continuation of application No. 16/124,424, filed on Sep. 7, 2018, now Pat. No. 10,272,307, which is a (Continued)

(51) Int. Cl.
*A63B 61/00* (2006.01)
*A63B 61/04* (2006.01)

(Continued)

(52) U.S. Cl.
CPC ..... *A63B 61/04* (2013.01); *A63B 71/0608* (2013.01); *A63B 71/0622* (2013.01);

(Continued)

(58) Field of Classification Search
CPC ..... A63B 61/00; A63B 61/003; A63B 61/006; A63B 69/38; A63B 71/06; A63B 71/0605;

(Continued)

(56) References Cited

U.S. PATENT DOCUMENTS 401,082 A 4/1889 Taylor
3,415,517 A 12/1965 Krist (Continued)

FOREIGN PATENT DOCUMENTS

CN 2198948 Y 5/1995
DE 3942255 A1 7/1991

(Continued)

OTHER PUBLICATIONS

International Preliminary Report on Patentability for International Application No. PCT/US2013/072408 dated Jun. 11, 2015.

(Continued)

*Primary Examiner* — Raleigh W Chiu
(74) *Attorney, Agent, or Firm* — Carlson, Gaskey & Olds, P.C.

(57) ABSTRACT

Disclosed is system and method for measuring the tension of a tennis net, and, alternatively or in addition, for determining if a service let occurs via the measuring of the net tension. The disclosed embodiments measure a force exerted on the center-strap or the singles stick by the net. In these embodiments, the measured force provides an accurate reflection of the tension of the net.

20 Claims, 7 Drawing Sheets

Related U.S. Application Data continuation-in-part of application No. 15/601,721, filed on May 22, 2017, now Pat. No. 10,080,943, which is a continuation-in-part of application No. 14/646,230, filed as application No. PCT/US2013/072408 on Nov. 27, 2013, now Pat. No. 9,687,707.

(60) Provisional application No. 61/737,284, filed on Dec. 14, 2012, provisional application No. 61/730,238, filed on Nov. 27, 2012.

(51) Int. Cl.
*A63B 71/06* (2006.01)
*A63B 69/38* (2006.01)
*A63B 102/02* (2015.01)

(52) U.S. Cl.
CPC ..... *A63B 2071/0613* (2013.01); *A63B 2071/0625* (2013.01); *A63B 2071/0655* (2013.01); *A63B 2102/02* (2015.10); *A63B 2207/02* (2013.01); *A63B 2220/51* (2013.01); *A63B 2225/50* (2013.01)

(58) Field of Classification Search
CPC ..... A63B 71/0608; A63B 71/0619; A63B 71/0622; A63B 2071/0613; A63B 2071/0625; A63B 2220/51; A63B 61/04; A63B 2071/0655; A63B 2102/02; A63B 2207/02; A63B 2225/50
See application file for complete search history.

(56) References Cited

U.S. PATENT DOCUMENTS

| | | | |
|---|---|---|---|
| 3,677,077 | A | 7/1972 | Merryman et al. |
| 3,697,867 | A | 10/1972 | Kleesattel |
| 3,774,194 | A | 11/1973 | Jokay et al. |
| 3,924,261 | A | 12/1975 | Kardashian |
| 3,982,759 | A | 9/1976 | Grant |
| 4,004,805 | A | 1/1977 | Chen et al. |
| 4,081,798 | A | 3/1978 | Pelfrey |
| 4,398,724 | A | 8/1983 | Wilson et al. |
| 4,844,455 | A | 7/1989 | Funkhouser, Jr. |
| 4,973,055 | A | 11/1990 | Muir |
| 5,215,310 | A | 6/1993 | Allbright |
| 5,320,344 | A | 6/1994 | Henderson |
| 5,585,778 | A | 12/1996 | Brauer et al. |
| 6,248,030 | B1 | 6/2001 | Pierce |
| 7,823,466 | B2 | 11/2010 | Glass |
| 8,806,952 | B1 | 8/2014 | Glass |
| 9,687,707 | B2 | 6/2017 | Goldstein |
| 10,080,943 | B2 | 9/2018 | Goldstein |
| 10,272,307 | B2 * | 4/2019 | Goldstein ..... A63B 61/04 |
| 2005/0164811 | A1 | 7/2005 | Barbier |
| 2007/0099732 | A1 | 5/2007 | Scarpa, III et al. |
| 2007/0129185 | A1 | 6/2007 | Schank et al. |
| 2009/0056476 | A1 | 3/2009 | Glass |
| 2011/0205555 | A1 | 8/2011 | Lorhpipat |
| 2011/0230265 | A1 | 9/2011 | Amit |
| 2012/0295743 | A1 | 11/2012 | Williams |
| 2014/0163990 | A1 | 6/2014 | Street |
| 2015/0283439 | A1 | 10/2015 | Goldstein |
| 2017/0252618 | A1 | 9/2017 | Goldstein |

FOREIGN PATENT DOCUMENTS

| | | | |
|---|---|---|---|
| DE | 4426977 | A1 | 3/1995 |
| GB | 2070942 | A | 9/1981 |
| WO | 2014085708 | A1 | 6/2014 |

OTHER PUBLICATIONS

European Search Report for European Application No. 13858909.8, dated Jun. 15, 2016.

* cited by examiner

TENNIS NET TENSION SYSTEM INCLUDING SERVICE LET INDICATION FEATURE

RELATED APPLICATIONS

This application is a continuation of U.S. patent application Ser. No. 16/124,424, filed Sep. 7, 2018, which is a continuation-in-part of prior U.S. application Ser. No. 15/601,721, filed May 22, 2017, which is a continuation-in-part of prior U.S. application Ser. No. 14/646,230, filed May 20, 2015, which is a national stage entry of PCT/US2013/072408, filed Nov. 27, 2013. The '408 PCT Application claims the benefit of U.S. Provisional Application No. 61/730,238, filed Nov. 27, 2012, and U.S. Provisional Application No. 61/737,284, filed Dec. 14, 2012. The entirety of each of these disclosures is herein incorporated by reference.

BACKGROUND

On all tennis courts, perhaps the most notable part is the net. In one known example, a tennis net includes two main net posts placed at a pre-determined height (e.g., 107 cm), and positioned a distance (e.g., 91.4 cm) outside the outermost (or doubles) sidelines of a tennis court. The net is typically composed of a woven or plastic netting supported by an upper net cable. The netting hangs from a strong metal cable via a white net tape. The net cable is attached to one post and then to the opposite post, which has a crank that winds the cable so that the net tightens and rises up to the required height and a desired tension.

In the middle of the net, there is a center-strap (also known as a mid-strap) which holds the net down by coming over the top of the net and being fastened to a clasp on the playing surface. This provides greater tension than a crank could practically provide (by pulling down at the mid-point of the net), since cables generally will sag, and provides the defined low part of the net in the center, and at an determinable height, which is an important during play. The result is a semi-V shape running in the top part of the net, where the center strap provides the regulation 91.4 cm height of the net in the middle.

In many tennis tournaments throughout the world, each net can be different. Wimbledon is known for a loose net while the U.S. Open is known for having a tight highly tensioned net. In fact, because both tournaments are outdoors, the net may be taken down as much as several times on any particular day with inclement weather. From tournament to tournament, and court to court, and even from day to day, and hour to hour, there lacks a precise, uniform net tension in tennis. And with this varying net tension, comes varying net heights (as net height is directly correlated to net tension, as explained further below).

When net tension is different, balls that clip the very top of the net ("net tape") during a rally will dribble over a loose net (resulting in what is called a cheap point), as a net with a looser tension absorbs the forward movement of the ball, allowing balls which hit the tape to roll over to the other side of the net. Conversely, with a tight net, the ball that clips the net tape will either sit up for an easy put away, or bounce out for a loss of the point, as tighter tensions do not absorb the forward pace and either send balls hitting the tape backward or cause the ball to change trajectory and fly out. This causes inconsistency in playing conditions.

Additionally, as mentioned, when net tension is different, the height of the net will be different. This is despite the fact that the net post is a defined height, as is the center-strap (107 cm and 91.4 cm respectively). The net traverses the court typically at 12.8 m in length (or 10.97 m for a singles net post). The net itself weighs approximately 10 kg (alternately approximately twice that for the ATP World Tour nets). Therefore, there will be a measurable sag in the net even when it is cranked up to reach the center-strap 91.4 cm height. The more one cranks thereafter, the tighter the net, thus as the net tension increases, the sag between the net posts/singles sticks and the center-strap will lessen, as the net cable will straighten out while being pulled tighter (resulting in different heights between those two points). This non-measured cranking (done essentially by "feel") can result in not only an inconsistent net tension but also an inconsistent net height. While the height of a net is the same for players on both sides, a player with more top spin will have an advantage over a player who hits a flatter ball when the net height can vary as much as several millimeters over the most of the playing area of the net (and as much as 1 cm at the midpoint between the singles stick and center-strap where the sag is greatest). Further, players who prefer to hit down the line (as opposed to cross court) will have a lower/higher net height at precisely that part of the net, with potentially different results of any such shot, depending upon the net tension. As the court itself has strictly defined dimensions and measurements in millimeters, as determined by the tennis governing bodies, and thus define the height of the net at any given point by virtue of knowing (and creating) the net tension.

For serves, the current rules call for a "service let," which is when the ball clips the net and still falls inside the service box. Loose nets will likely result in more lets while tight nets more likely cause the ball to either bounce back, sit up, or fly further and thus out (a "fault"). Professional tennis had recently considered removing the "service let." Should this still happen in the future, more "aces" will occur with loose nets (as the ball dribbles over to the other side) while tight nets will cause more balls to sit up for easy winners by the opponent or will go fly out for a loss of the point. The result is different depending upon the net tension. This is unacceptable, as the effect can be different on different courts and even change on the same court on the same day when the net often needs to be taken down on outdoor courts during rain, or to change nets during events with different tours (which have different nets). The result is an ever varying net tension and height for virtually each time a net is set up. This is because the precise height of the net on either side of the centerstrap to each of the net posts (and thus the majority of the playing area) is dependent upon the net tension. Even after the tension is sufficient to pull the centerstrap up to its regulation 91.4 cm (3 ft) height, there remains a sag. Further cranking of the net not only increases the net tension but also straightens up the sag, which raises the net in varying degrees along its length, with the largest increase at the middle of the net between the centerstrap and net posts where most balls pass, and least amount moving closer to either the centerstrap or the net post. At this midpoint, the height differential between a loose net and a tight net can result in up to a centimeter or more discrepancy. Such a difference can have significant effects on play. Therefore, the need to regulate the net tension is more than just how the ball reacts after striking the top of the net cord. It determines the precise height of the net at the most critical parts of the court.

SUMMARY

There is a need for consistency in net tension across tennis. Disclosed is system and method for measuring the tension of a tennis net, and, alternatively or in addition, for determining if a service let occurs via the measuring of the tension. The disclosed embodiments measure a force exerted by the net on a center-strap or a singles stick. In these embodiments, the measured force provides an accurate reflection of the tension of the net.

The embodiments, examples and alternatives of the preceding paragraphs, the claims, or the following description and drawings, including any of their various aspects or respective individual features, may be taken independently or in any combination. Features described in connection with one embodiment are applicable to the other embodiments, unless such features are incompatible.

BRIEF DESCRIPTION OF THE DRAWINGS

The drawings can be described as follows:

In FIG. 7, a light is configured to become illuminated to indicate a let has occurred.

In FIG. 8, a speaker is configured to make a relatively loud sound, such as a beep, to indicate a let has occurred.

DETAILED DESCRIPTION

Figure 1:
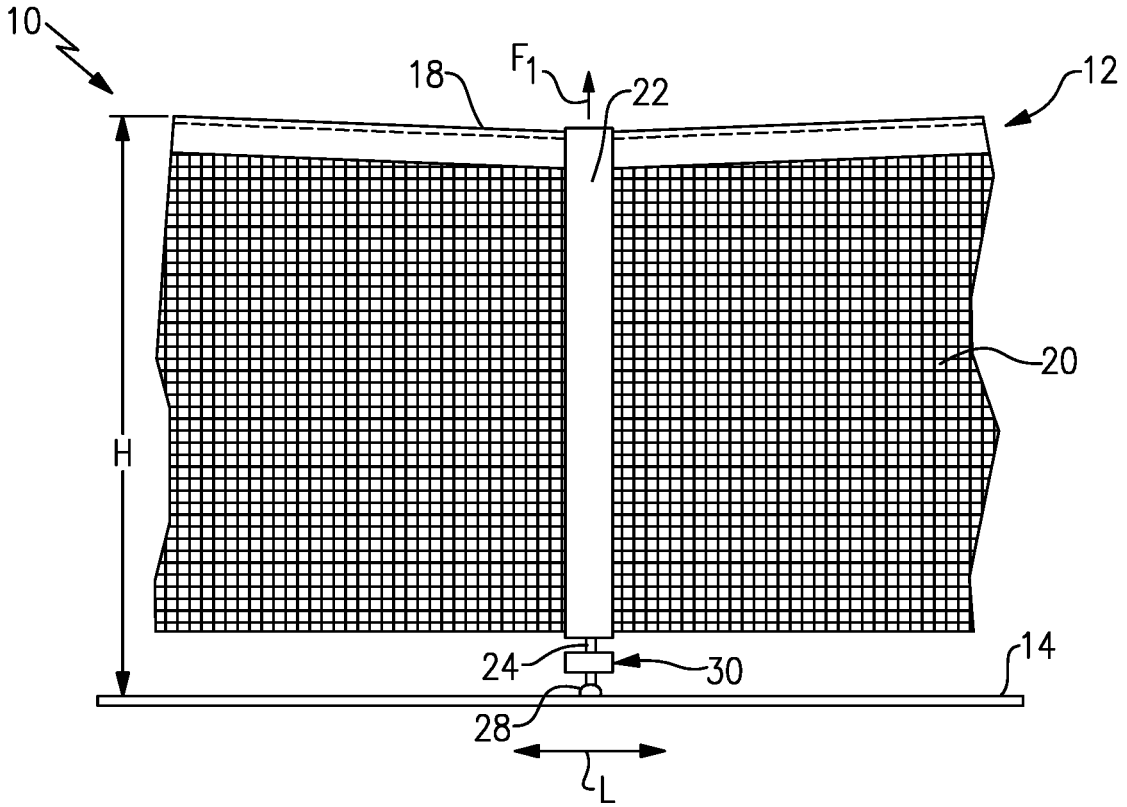
FIG. 1 is a view of an example net tension system.

FIG. 1 illustrates an example net tension system 10. The system 10 is used in connection with a net 12, which spans a playing area 14 in a direction of its length L. The playing area 14 in one example is a tennis court, and the net 12 is a tennis net. This disclosure may be used outside of tennis, however.

Figure 4:
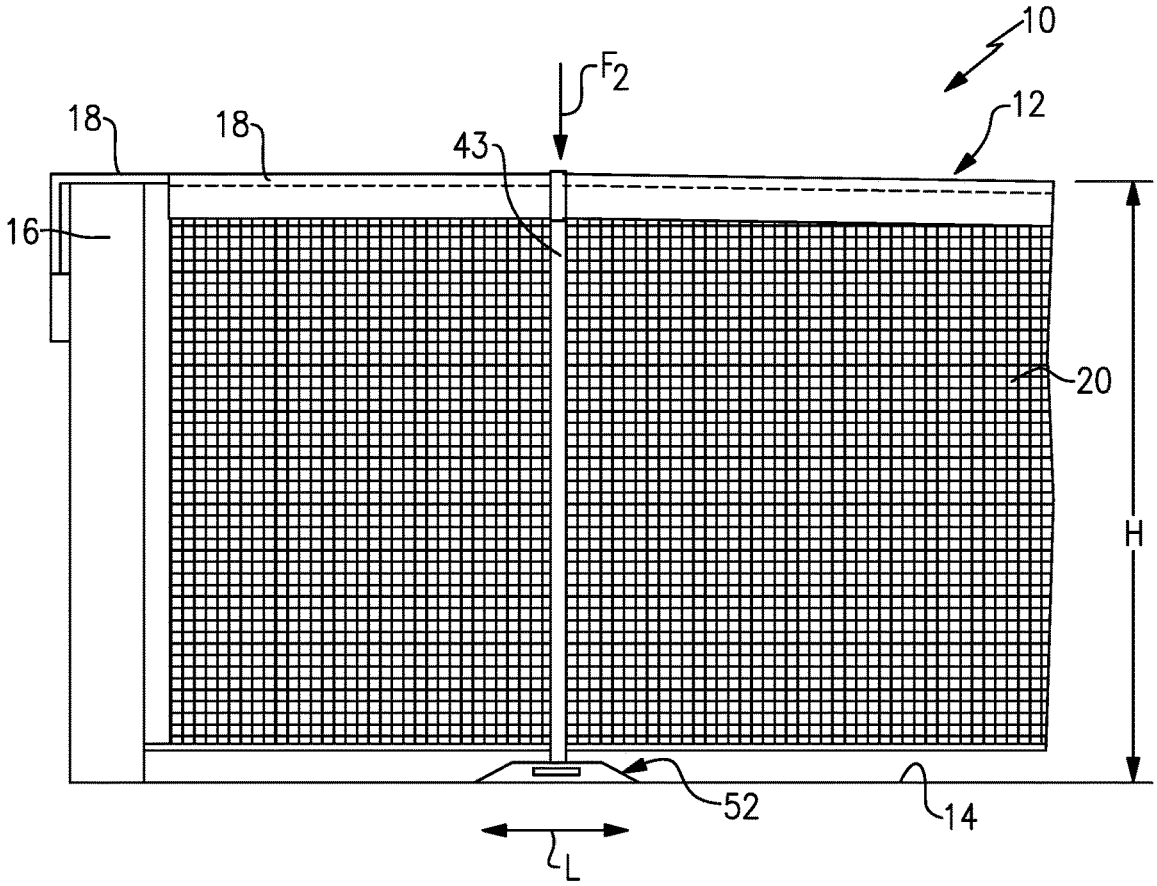
FIG. 4 is a view of still another example net tension system.

The net 12 is supported on opposite sides of the playing area 14 by net posts 16 (FIG. 4). The net 12 includes an upper cable 18 (or, "net cable") supporting a mesh (or, netting) 20. The upper cable 18 spans the distance between the net posts 16. At least one of the net posts includes a crank (not shown) for adjusting the tension in the upper cable 18. This tension, in turn, tightens the net 12. For all intents and purposes, the term net tension describes the tightness of the net, and is directly related to the tension in the upper cable 18, as well as the force exerted by the net 12 on one or more connectors provided between the net 12 and the playing area 14 (such as the center-strap 22 and the singles stick 43).

The net 12 is connected to the playing surface 14, in this example, by a center-strap 22. The upper cable 18 exerts an upward force $F_1$ on the center-strap 22 in a direction substantially perpendicular to the length L of the net 12. This is because the net 12 is higher at each end (e.g., the net posts 16 are at 107 cm height) than in the middle, so the center-strap 22 necessarily pulls down upon the net 12, creating the upward force $F_1$. The center-strap 22 resists the force $F_1$ with an equal and opposite force to maintain the net 12 in a normal condition (the pre-determined height of the center-strap 22). The force $F_1$ is resisted by way of the center-strap 22 being connected to the playing surface 14. In one example, the center-strap 22 is connected to the playing surface by a cable 24 attached to a first connecting support 26, which is selectively attachable to a hook 28.

In one example of this disclosure, a scale 30 measures the force $F_1$ exerted by the upper cable 18 on the center-strap. The force $F_1$ is indicative of a tension in the net 12. That is, the higher the tension of the upper cable 18, the higher the force $F_1$ against the center strap 22. As used herein, the term "scale" refers to any force measuring device, including, but not limited to pull scales 32A-32D (FIG. 3A), compression scales, and load cells (such as tension load cells and tension meters). A system 10 solely for determining net tension would work with a standard scale, while a service let indicator (discussed below) may require a faster load cell to obtain speeds high enough to register a ball strike. In the example where the scale 30 is a load cell, such as an electronic load cell, the system 10 may include an amplifier/digitizer and other associated electronic components. The scale may be digital (as in pull scale 32D), or mechanical (e.g., spring-type, as in pull scales 32A-32C).

Figure 2:
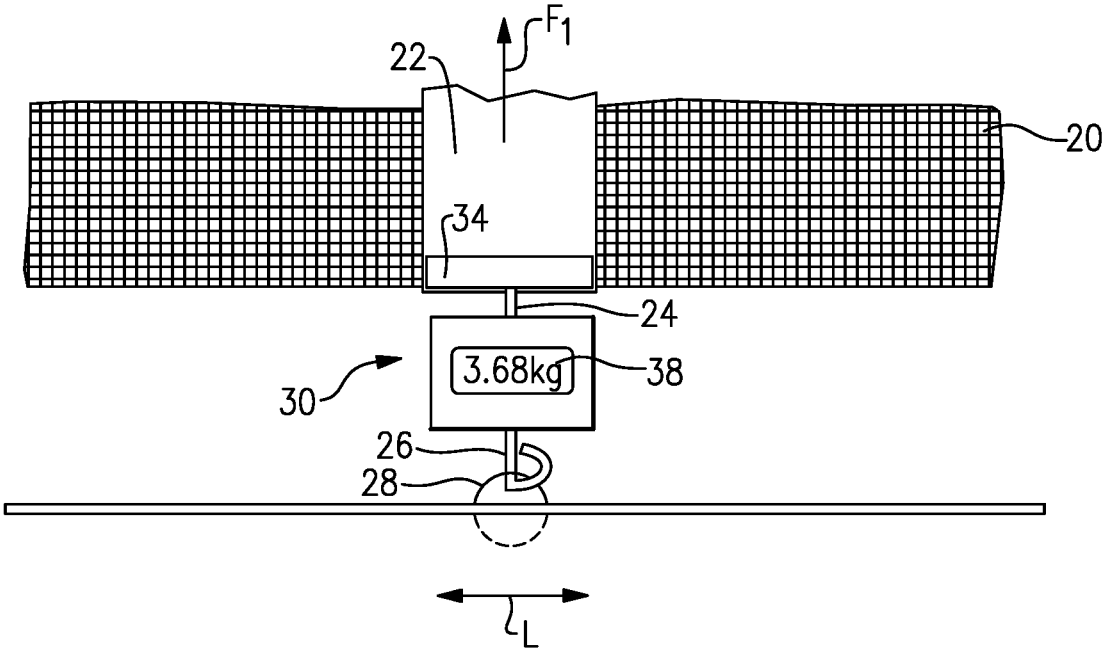
FIG. 2 is a close-up view of the system of FIG. 1.

As shown in FIG. 2, the scale 30 may be attached to the center-strap 22 by a cable 24, which can be connected to the center-strap 22 via a second connecting support 34. The first connecting support 26 is connected to the playing surface 14 via the hook 28, which is typically built-into tennis courts. If desired, an extension of the center-strap 22 can be attached via the first connecting support 26 to hang downwards and hide the scale 30. Alternatively, the color of the scale 30 may be selected to blend in with the net 12 or playing surface 14. The scale 30 may be connected to the center-strap 22 in other ways.

Figure 3A:
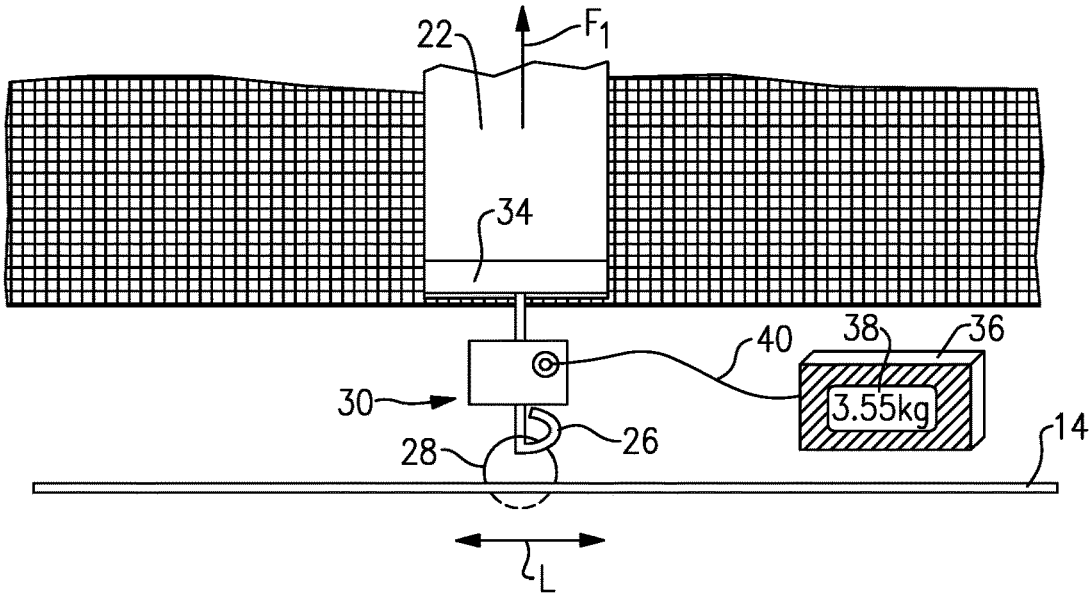
FIG. 3A is a view of another example net tension system.

As illustrated in FIG. 2, the scale 30 may include an indicator 36 expressing the force $F_1$ measured by the scale 30. In FIG. 2, the indicator 36 includes a digital display 38 that graphically expresses the measured force as a numerical quantity. The indicator 36 of FIG. 2 is attached to the scale 30. In other examples, such as in FIG. 3A, the indicator 36 is provided separately from the scale 30. In FIG. 3A, the indicator 36 may be selectively plugged into the scale 30, via cable 40, to obtain the force measurement. Alternatively, the indicator 36 may be in wireless communication with the scale 30. In one example, the indicator 36 is mounted near a chair umpire or other appropriate official for monitoring during the course of a tennis match. The indicator may include standard buttons, such as power, reset, etc. Because the tension of the net is directly correlated to the height of the net, this will alert the chair umpire (or other official) that, for example, the center-strap 22 has loosened (thus the tension will be lower), allowing the umpire to adjust it at an appropriate time during the match.

While this disclosure extends to all types of indicators 36, the indicator 36 of FIG. 3A may have the advantage of only being used during measurement, and not being exposed and vulnerable to damage during play. The indicator 36 of FIG. 3A further takes up less space, and is not readily visible, compared to that of FIG. 2. Moreover, since there are often several courts in any tennis club or professional tennis tournament, the (potentially) more expensive digital readout of the indicator 36 of FIG. 3A need not be purchased for each and every pull scale 14, since the measuring of the force $F_1$ can be done on several courts using the same indicator 36.

Figure 3B:
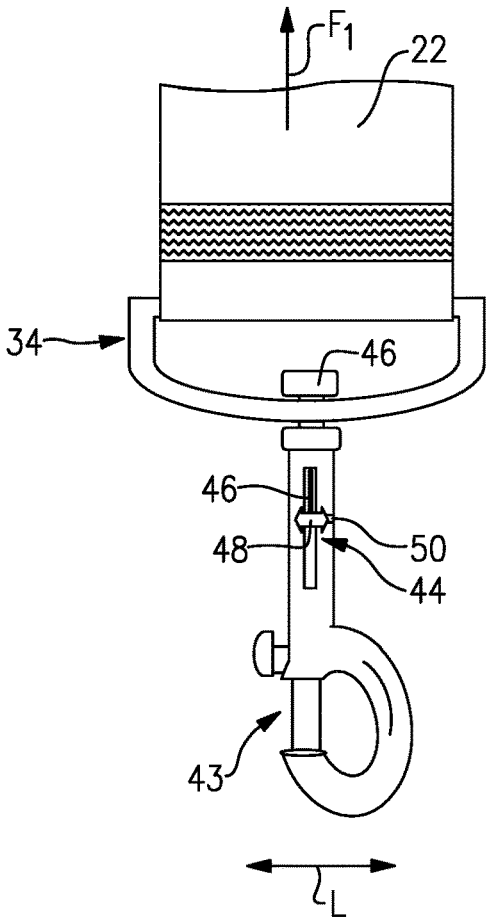
FIG. 3B is a view of yet another example net tension system.

FIG. 3B shows a variation in which a scale is built into a standard latching found in most tennis center-straps 22. The result is a scale and latching combination that is not appreciably larger than any standard latching. In one example, a pull scale 44 is incorporated into the latching 42. The pull scale 44 may include a spring acting on pin 46, which is connected to the center-strap 22 via the second connecting support 34. The pin 46 is moveable is responsive to the force $F_1$. The pin 46 is attached to an indicator 48 that moves relative to indicia 50. In one example, the indicia 50 corresponds to a preferred net tension. Other indicia may be present.

Figure 3C:
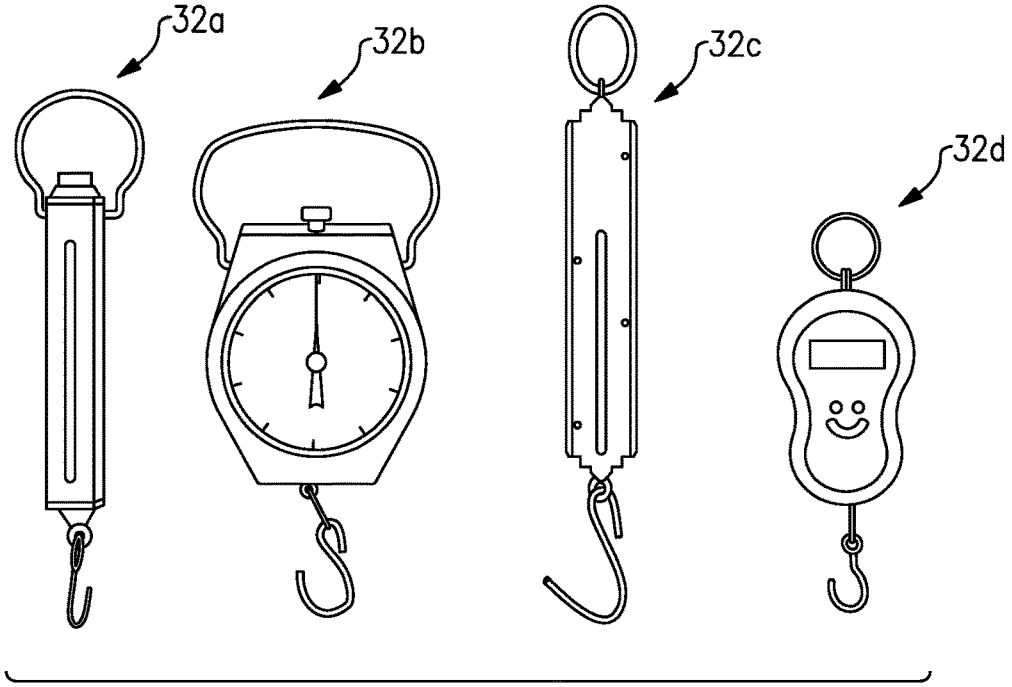
FIG. 3C illustrate example pull scales for use in the system of FIGS. 1-3A.

FIG. 3C shows three pull scales (e.g., 32A-32C) which are not electronic. While perhaps not as accurate or as easy to read, they have the potential advantage of greater durability, lower cost, and avoid the issue of batteries. These first three scales can be incorporated into this disclosure, should one desire a non-electronic scale. The fourth scale 32D is an example of an off the shelf pocket size digital pull scale.

As the upper cable 18 is adjusted, the force $F_1$ will change, and, in turn, so will the height H of the net 12 (between the net post 18 or the singles stick 43, and the center-strap 22) and the overall tension in the upper cable 18. In one example, a loose net may indicate a force $F_1$ of 4.5 kg while a tight net might show a force $F_1$ of 5.8 kg (approximately 44 N and 57 N, respectively). The scale 30 can accurately measure the force $F_1$. In the example of FIGS. 1-3B, the measurement is made at a point furthest away from the net posts 16 (e.g., at the center-strap), which may exhibit the least tension, and is also the part of the net 12 most in play. Thus, the force $F_1$ exerted on the center-strap 22 at this point may provide the most useful information about the overall tension of the net 12.

The measurement can be made with or without singles sticks 43 (FIG. 4), as long as all measurements obtained are consistently. This is, in part, because any change in the angle of a taut upper cable 18 necessarily increases the tension, thus the singles sticks 43 may change the force $F_1$ on the center-strap 22 (having created a more acute angle), and so measurements with/without the singles stick 43 will be markedly different. Because the placement of the singles sticks 43 must be exact, it may be preferred that the net tension is measured before the singles sticks 43 are placed, thus removing a possible variable. Further, when the upper cable 18 is cranked tighter, it moves slightly laterally and therefore may cause the singles sticks 43 to lose their exact vertical position.

Turning to another embodiment, FIG. 4 illustrates singles sticks 43 provided relative to the net 12. Singles sticks 43 may be used to provide a consistent measurement of the tension of the net 12. In this embodiment, a downward force $F_2$ from the upper cable 18 of net 12 is measured. It will be understood that the downward force $F_2$ exerted by the net 12 will vary depending on how far a particular point of measurement is from the net posts 16. A singles stick 43 is, by one example rule, positioned 91.4 cm from the sideline of a singles court. The height H of the net 12 at this point, by example, is 107 cm. As such, because the height and position of the singles stick 43 is precisely defined by the rules of tennis, it can be used to provide a uniform measurement to easily duplicate net tension. The downward force $F_2$ that the upper cable 18 exerts on the singles sticks 43, in a direction substantially perpendicular to the length L of the net 12, will accurately reflect a tension of the net 12, since the arrangement of the singles stick 43 will be the generally be consistent.

Figure 5:
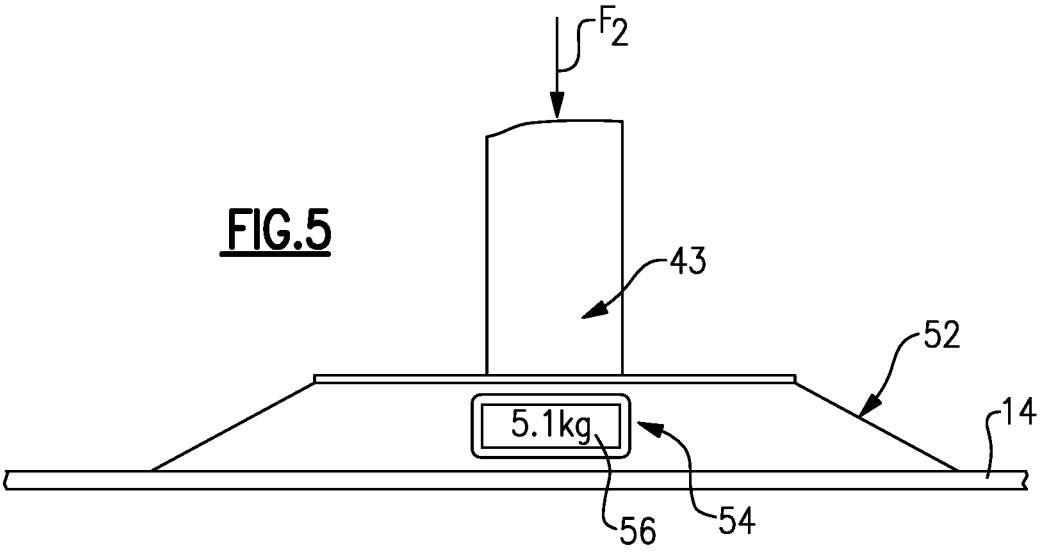
FIG. 5 is a close-up view of the example net tension system of FIG. 4.

In one example, the singles stick 43 is connected to a scale 52 at its base. Seen in detail in FIG. 5, this scale 52 can be built into the base of the singles stick 43 (as shown), built into the playing surface 14, or be a separate structure. The scale 52 may function substantially as described relative to the scale 30 of FIGS. 1-3B. For instance, the scale 52 may include an indicator 54 having a digital screen 56 for expressing the measured force $F_2$. This screen 56 can be incorporated into the scale 52 or be separate and attached via a cable when measurements are made.

While there are two singles sticks 43 commonly employed in tennis (one on each end of the net), only one stick is generally required to measure the net tension. Further, it will be appreciated that while a standard singles stick is placed 91.4 cm outside the singles sideline, one can also place the device at another point along the net.

Further, because the presence of the center-strap 22 changes the net tension, the measurements taken at the singles sticks 43 will be markedly different if a center-strap 22 is not used, or if used, not at its regulation 91.4 cm height. Thus, the presence or absence of the center-strap 22 should be noted when measuring the force $F_2$. Likewise, the presence or absence of the singles sticks 43 should be noted when measuring the force $F_1$ at the center-strap, as discussed relative to FIGS. 1-3B. This will, again, lead to consistency in the net tension.

Figure 6A:
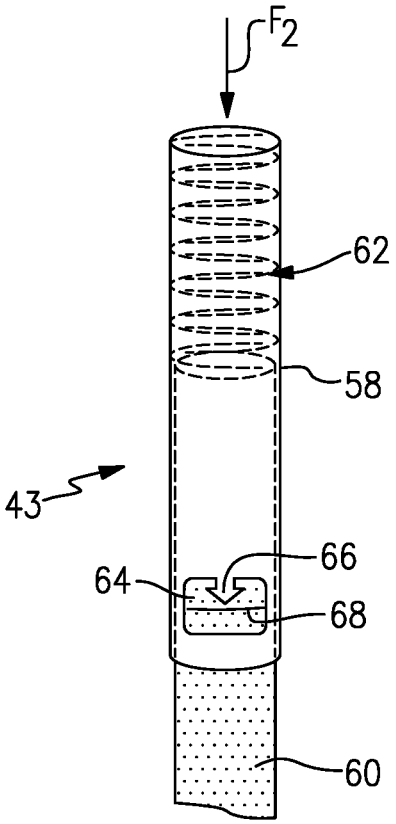
FIGS. 6A-6B show a further example net tension system.

FIG. 6A shows a non-digital scale for measuring the force $F_2$. In FIG. 6A, a singles stick 43 has a first section 58 overlapping a second section 60. The first section 58 is moveable relative to the second section 60. A spring 62 is provided inside the first section 58, and generally resists the force $F_2$ exerted on the singles stick 43 by way of the upper cable 18. Depending on the level of force $F_2$, the spring 62 will compress a corresponding amount. In turn, the first section 58 will move relative to a second section 62. The first section 58 in this example includes a window 64 and an indicator 66 that slides relative to indicia 68 on the second section 62. Like in the above examples, the indicia 68 may correspond to a preferred net tension.

Figure 6B:
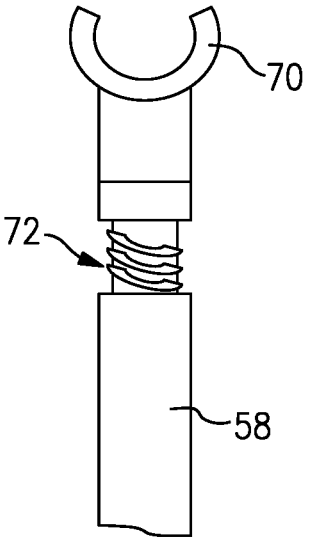

Turning to FIG. 6B, a U-shaped guide 70 may optionally be attached to the first section 58. The U-shaped guide 70 supports the upper cable 18, and may be adjustable relative to the first section 58 via threads 72. The threads 72 also allow the height of the singles stick 43 to be adjusted to meet the required 107 cm, while also allowing the singles stick 43 to customize the net tension.

Using any of the above embodiments, one can then duplicate a tension time and again. With no measureable variables, that is, the distance between the net posts (12.8 m), the inelasticity of the steel net cable, the height of the single post (107 cm), and the position of the singles stick (91.4 cm outside the single sideline), and the 91.4 cm height of the net at the center-strap, are all fixed by rule, the net tension will substantially be the exact same in each instance. This measurement can be used each time when putting a net up or can be used to simply test periodically that the net tension has remained the same.

An additional benefit of the system 10 relates to the service let rule. A serve that clips the net 12 but still falls in the service box is called a "let" and is re-played. With the instant disclosure, any ball that comes into contact with the net 12 will change the force (e.g., $F_1$ or $F_2$) caused by tension of the net 12. Such a contact and the resulting change in the force will be picked up by the scale. That is, the contact between the ball and the net changes the force $F_1$, $F_2$ from a normal level to a threshold level indicating that there has been contact between the net 12 and the ball.

The threshold force will be of an extremely short duration, and may create a unique "fingerprint" of a sharp spike (dip/peak). When the threshold force is met, an audible signal (beep) may be triggered, indicating a "let."

The fingerprint associated with the threshold force will be different than the effect that wind might have. Essentially, the effect of wind on the net tension is more of a constant push than the short-term impact associated with a ball strike. For example, even strong wind gusts have a duration in seconds, while a serve regularly is double or triple that speed, and has an impact duration in milliseconds. Measuring the change of force relative to time (e.g., how fast the force changed from one millisecond to the next one or more) will isolate the signature of a ball impact, allowing it to be identified separately from any wind effect (which will be filtered out). This unique ball strike signature can be used to set the sensitivity for what will be triggered by the threshold force, indicating a "let" ball.

Figure 9:
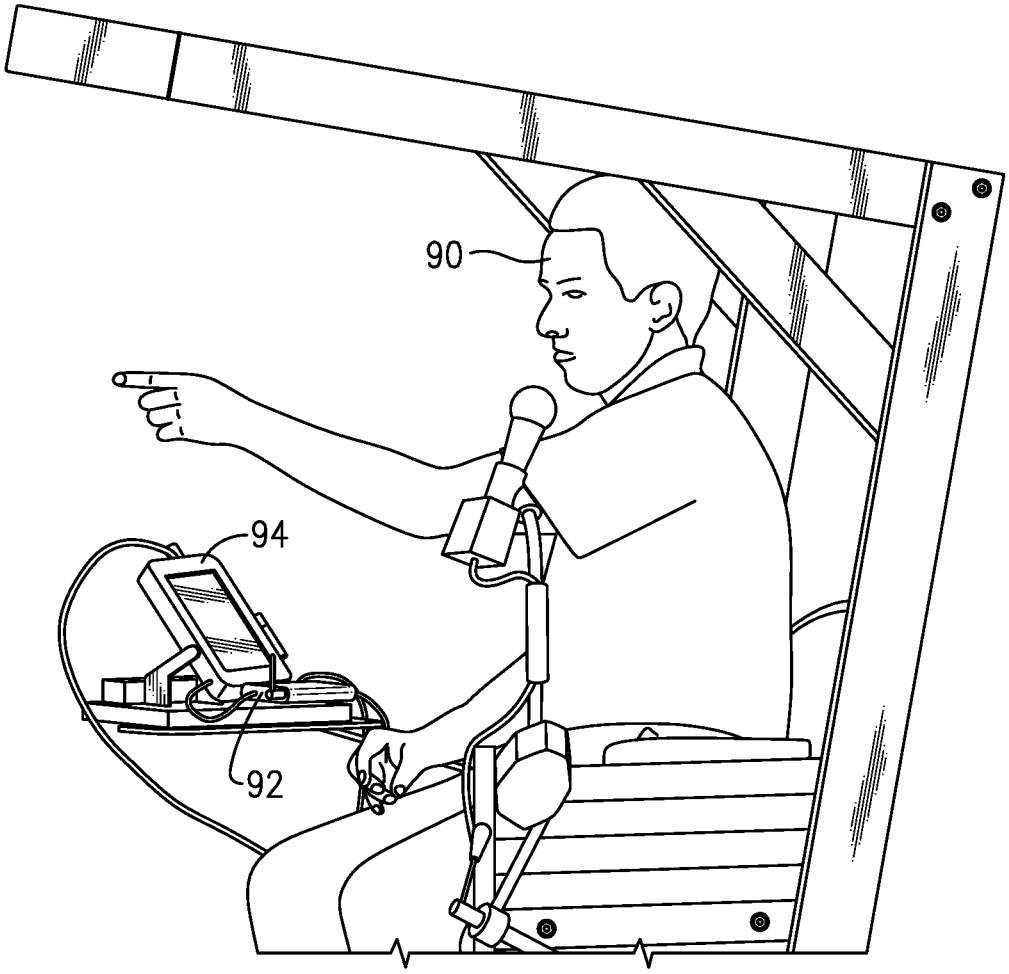
FIG. 9 illustrates a chair umpire, an example handset, and an example tablet.

With reference to FIG. 9, which illustrates a chair umpire 90, and with continued reference to the embodiment of FIGS. 1-3B, the force $F_1$ will be steeply lower during a ball strike (indicating contact as the ball presses the net downward, counteracting (lowering) the force $F_1$ of the upward pull against the center-strap), while for the singles stick 43, the force $F_2$ shown after a ball strike will be higher (as the ball slightly presses down on the net). If the change is short enough and strong enough, the threshold force will be reached (indicating a ball strike), thus triggering a beep or signal on the chair umpire device (i.e., the indicator). One example signal includes a vibration in a handset 92 used by the umpire 90. In this example, the armed button on the handset 92 pressed by the umpire 90 to activate the let detection function for the serve (i.e., during service) includes a haptic feedback device, such as an asymmetrical rotary device (e.g., an asymmetrical motor), configured to generate a vibration force when the threshold force is reached such that the umpire 90 feels the vibration when a let occurs, just as he might hear a beep. This ensures that the let is noticed by the umpire 90 even in a noisy stadium. Additionally or alternatively, the signal could include a light, such as an LED light turning, for example, from blue to red. The light and vibration may be used in combination with one another and/or in combination with the afore-mentioned beep, providing a redundant three senses signal (audio, haptic, visual) to ensure no let is missed by the umpire 90. The chair umpire 90 will activate the device only during a serve by pressing a button, which is then released, deactivating it as the point is under way (assuming there is no let or a service fault). At this time, a ball during a "rally" that clips the net, but lands into play on the other side, are not "lets" and are not replayed (these are typically called a "net cord" and play continues since the let rule only relates to serves). Signals indicating a net cord during a rally are neither needed nor desirable since it has no effect on play continuing.

Figure 10:
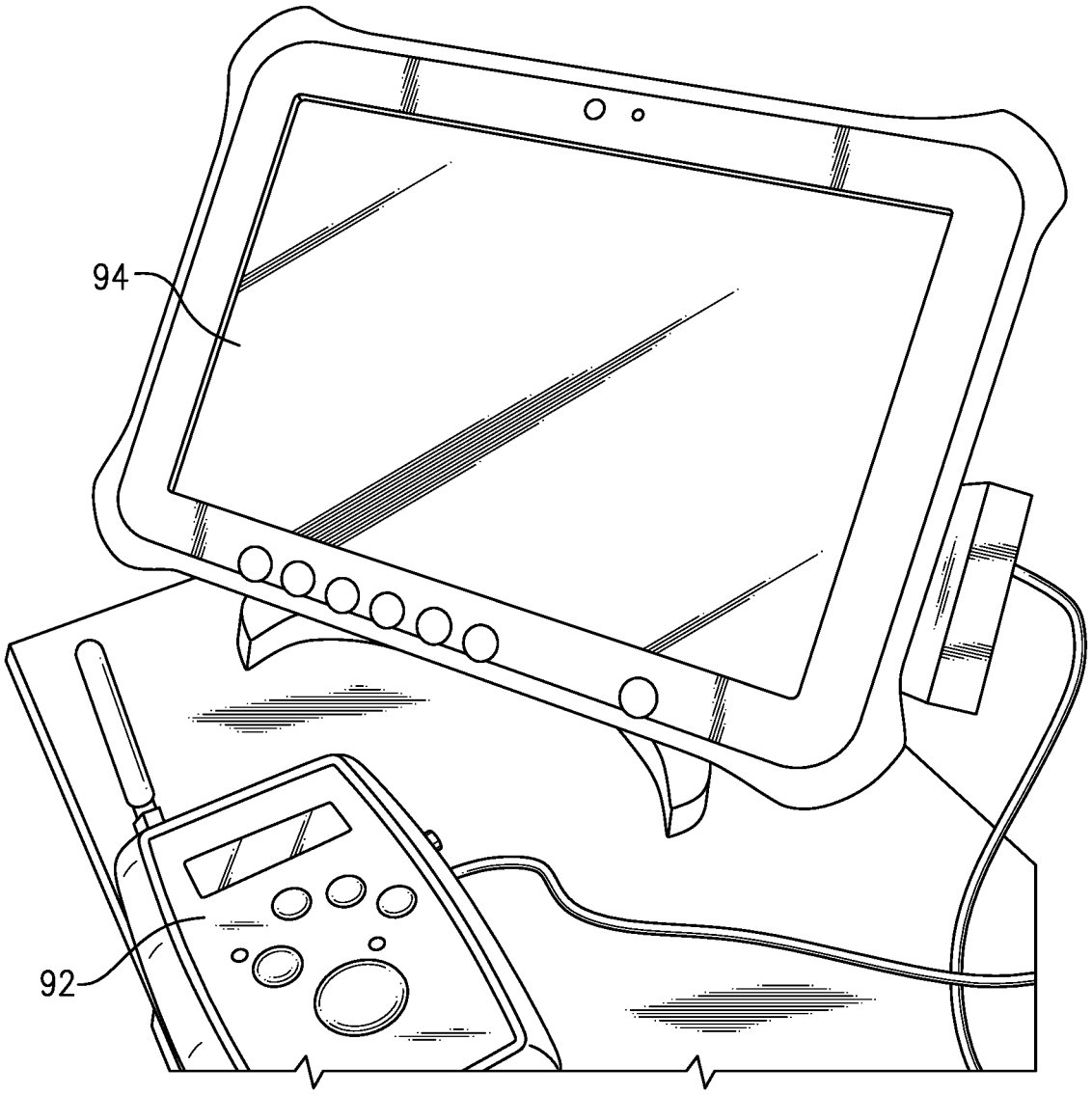
FIG. 10 is a close-up view of an example setup including an example handset and an example tablet.

As shown in FIGS. 9 and 10, the handset 92 may be coupled via a wired or wireless connection to another computing device, such as a tablet 94, which is mounted adjacent the chair umpire 90. Both the handset 92 and the tablet 94 are considered "computing devices" for purposes of this disclosure. Together, the handset 92 and tablet 94 display information to the chair umpire 90 pertaining to an ongoing match and allow the chair umpire 90 to control various functionality of the systems used during an ongoing match. As examples, the handset 92 may be electrically coupled to the scale 30 and/or indicator 36 and may display different information, e.g., let detection, the net tension, in units of force (i.e., pounds), centerstrap height, ball mark inspection, shot clock, etc., on a screen of the handset 92 and/or the tablet 94. The handset 92 may also monitor the centerstrap height and display the same to the chair umpire 90. Further still, the handset 92 may display the strength of various electronic signals, such as electronic signals between the handset 92 and the tablet 94, and/or signals between the tablet 94 and the scale 30 and/or indicator 36. The tablet 94, typically referred to as a "scoring tablet," controls the scoring and other specific information during the match (as well as the set up prior to the match) but may complement or substitute for the display on the handset regarding the aforementioned functions of the net system.

The handset 92 may include various buttons, including buttons for adjusting settings (e.g., algorithm, beep volume, etc.) and a SET button to enter settings (e.g., algorithm, beep volume, etc.). Further, the tablet 94 may include a software version of the handset 92, and thus the tablet 94 may be used in case of failure of the handset 92. To this end, this disclosure is not limited to use with systems including both a handset 92 and a tablet 94, and extends to systems having one, the other, or both. The handset 92 can be configured to display various information, such as displaying the volume of a beep during a let, for example, and including various LEDs and speakers to indicate, for example, pairing of a remote. The handset 92 and/or the tablet 94 may also show various warning signals, such as loss of wireless connection. In one example, when a wireless signal between the handset 92 and tablet 94 is lost, an LED flashing and "SIGNAL NONE" is displayed on the screen of the handset 92.

The handset 92 and/or tablet 94 may also include a shot clock control button, which can send a signal to selectively start, pause, or resume the shot clock. The "shot clock" indicates on court the 25 second maximum time a player has to serve (i.e., start the next point) after the prior point has ended. As noted above, the handset 92 may also, upon pressing an "ARM" button, which may be an electronic button on a screen of the handset 92 for example, send a signal to the tablet 94 to arm a let detection function and to indicate play has started (i.e., a "Start of Point" signal), which may be sent over the internet around the world.

Specifically, the "ARM" button may be depressed by the umpire 90 during service only, so that the let detection function is armed during service only, meaning lets, per the rules of tennis, are monitored during service only. The "ARM" button is typically deactivated during a rally such that the umpire (or players) is not distracted by notifications indicative of a non-service contact between the ball and net mid-rally. The handset 92 may also send a signal to the tablet 94, using the same button, indicating the next point has started, and which may be used by the tablet 94 to stop/disappear the shot clock from the on-court screen. The handset may manually send the signal to the tablet (using a key sequence) via a button on the handset to start, stop, pause, or resume the 25 seconds time allowed to commence the next point (much like a 30 second shot clock in basketball). The tablet may be connected to the shot clock (cable or wireless) and therefore can control its various functions. The handset may alternatively have a direct connection with the shot clock, wired or wireless, in order to control it. The handset 92 and/or table 94 may also receive signals from a ball mark inspection ("BMI") remote (not shown), which indicates that the chair umpire 90 has just left his or her chair to perform a ball mark inspection. This may occur during clay court tournaments when the umpire leaves his chair to see the mark a ball makes when it hits the court surface in order to check if the ball is in or out. The tablet 94 may, in turn, send a corresponding signal out to the world that all internet gambling is suspended until the score is input by the umpire 90 upon his or her return to the chair, which prevents chance opportunists on site from placing bets using real time information. This aspect of the disclosure has added relevance in the context of a clay court tournament where the ball makes a visible mark which allows the chair umpire to check a disputed line call. For hard court and grass, typically an automated system, such as the "Electronic Line Calling" is used to determine whether a ball lands inbounds and thus manual court inspection is never performed. The device can automatically reset without any manual intervention by the umpire and be ready for the next ball mark inspection.

Other means of detecting when an umpire chair has left to make a ball mark inspection are publically known, such as a pressure cushion or a so called "dead man's switch" which is a connection (one end to the chair and the other to the chair umpire) that is physically broken when two magnetically connected circuits are separated when the chair umpire leaves his chair. There are distinct disadvantages in such devices.

In one aspect of this disclosure, a separate device, such as a secondary simplified handset, may be paired to a base which houses the scale 30 and configured to display the net tension, in units of force (i.e., Newtons). This separate device may be utilized by a grounds crew as they crank up the net, allowing them to see in real time the precise tension until they reach a target net tension. The target tension may be set at the beginning of the tournament and indicated on the display of the handset to show the preferred net tension. Typically, the handset 92 is only accessible by the chair umpire 90 and not accessible by the grounds crew. Rather than waiting for the umpire to arrive on court and give feedback, the grounds crew can have access to net tension information via the separate device. The separate device may pair to the scale 30, either by a wired or by contact, and preferably operating via wireless connection with the base (the net crank is on one of the two net posts 6.4 m from the middle of the net where the base is). It may be particularly useful by the grounds crew when setting up the net during tournaments where the net will go up and down multiple times a day, thus ensuring the grounds crew can rapidly and safely reach the target net tension as they are operating a crank to apply tension to the net during set up. The separate device reduces, or eliminates, any need for the chair umpire to communicate the net tension to the grounds crew since the grounds crew has access to real time net tension via the separate device. The separate device may also show the battery level of the base, unit number, and other information.

Figure 7:
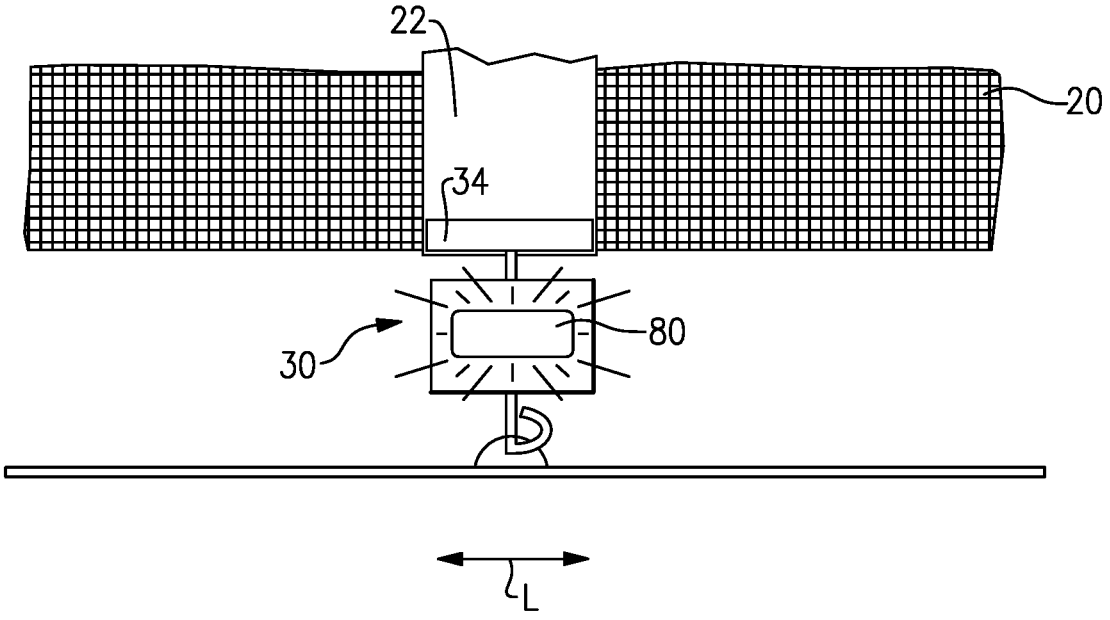
FIG. 7 shows a further example system.

The let indication feature may also be useful in matches, such as club matches or recreational matches, which do not typically involve a chair umpire. FIG. 7 schematically illustrates an embodiment in which an indicator is provided by a light 80. In this example, the light 80 has been incorporated into the scale 30. In one example of use, the light 80 is normally not illuminated during play, and is configured to illuminate when the above-mentioned threshold force is reached. The light 80 may be an LED light configured to illuminate a color that is easily visible by the players, such as red. The red light may stay illuminated for a set period of time, such as 5 seconds, after the let occurs to allow the players to view the light. Thus, when the light is on immediately after a serve, the players know that a let has occurred. If the light, however, comes on during a rally (when play continues even if the ball clips the net cord), the players can ignore the light. Thus, positioning the light 80 on the scale 30, or alternatively in another location, near the bottom of the center-strap 22, for example, helps avoid distracting the players during play.

In another example of use, the light 80 is always illuminated during play in a first color, such as green, which indicates that the above-mentioned threshold force has not been reached. When the threshold force is reached, the color of the light 80 changes to a second color, such as red. If the second color appears immediately following a serve, the players know that a let occurred. If the second color appears during a rally, the players can simply ignore the light.

While only one side of the scale 30 is illustrated in FIG. 7, it should be understood that there may be another light 80 on the opposite side of the scale 30 such that both players can see the light. Alternatively, the light 80 can be positioned on a side of the scale 30 such that it is visible from both sides of a tennis court. Further still, the light 80 could be positioned elsewhere, and need not be incorporated into the scale 30. For example, the light could be positioned below the center-strap 22 or could be positioned off the court in a location easily viewed by both players, such as a net post. Again, since there is no chair umpire or other individual to constantly turn the indicator on and off before a serve, the let detection system of the light 80 may always be activated during play, not just during service. Thus, this disclosure provides the light 80 in a location such that it does not distract the players during a rally, particularly where there is a let cord, but also such that players can easily view the light 80 when desired, such as during service and after a possible let.

Figure 8:
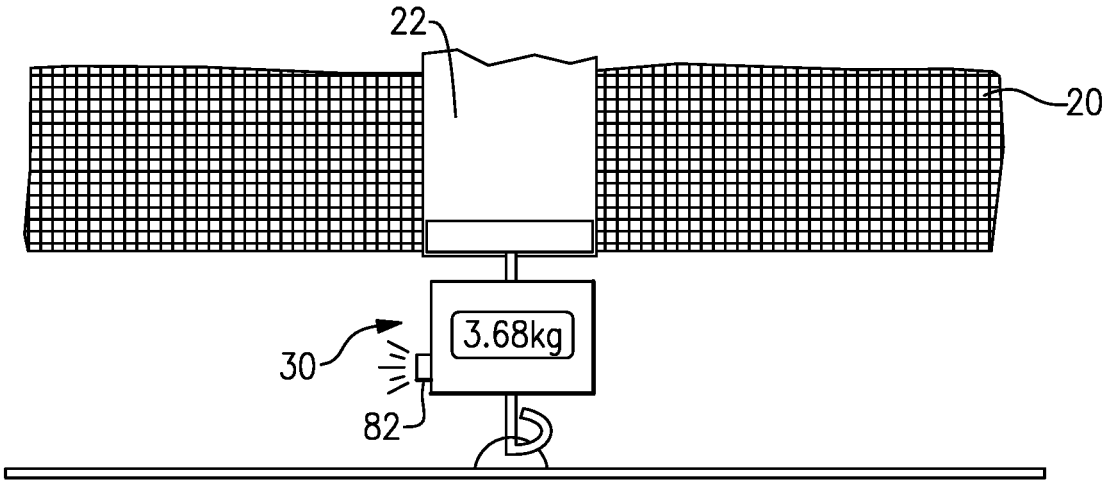
FIG. 8 shows a further example system.

FIG. 8 illustrates another example embodiment that is useful in situations where there is no chair umpire. In FIG. 8, the indicator is provided by a speaker 82 configured to make a relatively loud beep when the above-mentioned threshold force is reached. In this example, the speaker 82 is incorporated into the scale 30, but, as with the light 80, that need not be the case. The speaker 82 could be positioned in another location adjacent the tennis court. Both players will be able to hear the beep from the speaker 82, indicating that a let has occurred. The embodiment of FIG. 8 can be used in combination with the embodiment of FIG. 7. That is, a beep could be used in combination with illumination of a light (or a change in color of an already-illuminated light) to indicate that a let has occurred.

It will be appreciated that players could have the ability to activate the let detection function right before a serve, and where the device would automatically de-activate seconds later in order to avoid a possible let signal in a rally. Either or both of the players could activate the device, say, by pressing a button on their person or racket wirelessly connected to the base that activates it right before the serve. While this would require one of the players to remember to activate the device each time before a serve is made, it provides the option of activation of the device only at the time of the serve.

That said, the embodiments of FIGS. 7 and 8 are provided such that the signal, whether audio, visual, or otherwise, will not disturb players during a rally, but the signal could be such that if one player believes that a let occurred, that both players can use the disclosed device to confirm that a let did indeed occur. For example, an example visual signal could be a bright, flashing light, or alternatively could be a discrete light or beep that avoids distracting players but will still provide confirmation if a player calls a let. Thus, since most tennis is not played at the professional level, where chair umpires are always used, this disclosure provides amateur players with a way to enforce an important rule in tennis—the let rule.

Although the different examples have the specific components shown in the illustrations, embodiments of this claimed invention are not limited to those particular combinations. It is possible to use some of the components or features from one of the examples in combination with features or components from another one of the examples. Furthermore it is appreciated that distances or features in the drawings may be reduced or exaggerated for illustrative purposes and do not in any way so limit the embodiment shown.

For example, while the forces $F_1$ and $F_2$ are substantially perpendicular to the length L of the net 12, in an alternate embodiment the scale 30 is arranged to measure the tension in the upper cable 18 directly, although this arrangement may lack sensitivity and responsiveness for the required measurements.

As another example, while specific distances such as 107 cm and 91.4 cm have been mentioned above, as currently required by all tennis governing bodies, it should be understood that this disclosure extends to systems including other distances which may include other sports which employs nets. For instance, if the regulations from the tennis governing bodies are followed, the difference between the height at the net posts 16 and the center-strap 22 will be 15.6 cm. However, in some instances the regulations are not followed, resulting in a height difference of about 15.6 cm. As used herein, the term "about" is not a boundaryless term, and should be interpreted in the way one skilled in the art would interpret the term. Similarly, measurements as described in the screen readout are given as examples only and will be different under use.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A system, comprising:

a net extending across a tennis court;

an indicator expressing when a force associated with the net exceeds a threshold force during a short duration using at least one of (1) a vibration force, (2) a light, and (3) a sound, the threshold force being indicative of an impact between a ball and the net; and a computing system including a button which, when pressed, arms a let detection function, wherein the indicator is only operable when the let detection function is armed, and the computing system further includes a button which, when pressed, controls a shot clock in order to help enforce a time limit imposed upon a player at various stages of a tennis match.

2. The system as recited in claim 1, wherein the computing system includes at least one of a handset and a tablet.

3. The system as recited in claim 2, wherein the handset includes the button which, when pressed, sends a signal to the tablet to start, stop, pause, or resume the shot clock.

4. The system as recited in claim 1, wherein the shot clock is situated on the tennis court.

5. The system as recited in claim 1, wherein the computing system is at least partially mounted upon or adjacent to a chair of a chair umpire.

6. The system as recited in claim 1, wherein the indicator includes a haptic feedback device incorporated into a handset used by an umpire, official, or other person, and the vibration force is generated by the haptic feedback device when the threshold force is met or exceeded.

7. The system as recited in claim 1, wherein the indicator includes one of a light and an audio indicator.

8. The system as recited in claim 1, wherein the threshold force is based on a fingerprint, and the fingerprint is a unique sharp spike in an output of a force measuring device during the short duration and is indicative of an impact between a ball and a net during a serve.

9. A method, comprising:

measuring a force associated with a net extending across a tennis court;

indicating, using an indicator, whether the force meets or exceeds a threshold force during a short duration using at least one of (1) a vibration force, (2) a light, and (3) a sound, the threshold force being indicative of an impact between a ball and the net;

pressing a button on one of a handset and a tablet to arm a let detection function, wherein the indicating step is only performed when the let detection function has been armed; and pressing a button on one of the handset and the tablet to control a shot clock in order to help enforce a time limit imposed upon a player at various stages of a tennis match.

10. The method as recited in claim 9, wherein the step of pressing the button controls the shot clock to help enforce a time limit imposed upon the player during a service game.

11. The method as recited in claim 9, wherein the shot clock is situated on the tennis court.

12. The method as recited in claim 9, wherein controlling the shot clock includes starting, stopping, pausing, or resuming the shot clock.

13. The method as recited in claim 12, wherein a button is pressed on the handset which sends a signal to the tablet to start, stop, pause, or resume the shot clock.

14. The method as recited in claim 9, wherein the let detection function is armed during the service game of the player and is not armed during a rally of the tennis match such that the indicating step is not performed during the rally.

15. The method as recited in claim 9, wherein the indicator includes a haptic feedback device, and the indicating step includes generating the vibration force with the haptic feedback device when the threshold force has been met or exceeded.

16. The method as recited in claim 15, wherein the haptic feedback device is incorporated into the handset.

17. The method as recited in claim 9, wherein the indicator includes a light, and the indicating step includes illuminating the light.

18. The method as recited in claim 17, wherein indicating step includes illuminating the light in a first color when the threshold force has not been met or exceeded and further includes illuminating the light in a second color different than the first color when the threshold force has been met or exceeded.

19. The method as recited in claim 9, wherein the indicator is an audio indicator, and the indicating step includes generating the sound when the threshold force has been met or exceeded.

20. The method as recited in claim 9, wherein the threshold force is based on a fingerprint, and the fingerprint is a unique sharp spike in an output of a force measuring device during the short duration and is indicative of an impact between a ball and a net during a serve.

* * * * *